US007527156B2

(12) United States Patent
Wisnoski et al.

(10) Patent No.: US 7,527,156 B2
(45) Date of Patent: May 5, 2009

(54) TOOL CADDY

(75) Inventors: John R. Wisnoski, Haubstadt, IN (US); Wyatt A. Cline, Niles, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 296 days.

(21) Appl. No.: 11/179,931

(22) Filed: Jul. 12, 2005

(65) Prior Publication Data

US 2007/0012636 A1 Jan. 18, 2007

(51) Int. Cl.
*A47F 5/00* (2006.01)
*A47F 7/00* (2006.01)

(52) U.S. Cl. ..... 211/70.6; 211/94.01; 211/103

(58) Field of Classification Search ..... 211/70.6, 211/189, 87.01, 94.01, 60.1, 62, 63, 65, 67, 211/68, 69, 70.2, 70.8, 94.02, 103; 206/372; 144/286.1, 285, 286.5; 248/224.41, 224.51; 174/494

See application file for complete search history.

(56) References Cited

U.S. PATENT DOCUMENTS 2,805,777 A * 9/1957 Larson ..... 211/70.6
3,045,961 A * 7/1962 Cygan ..... 248/222.12
3,268,087 A * 8/1966 Kramer ..... 211/70.6
3,269,550 A 8/1966 Marcus
3,298,531 A * 1/1967 Wilcke ..... 211/70.6
3,337,058 A * 8/1967 Sandrick ..... 211/69
D265,941 S * 8/1982 Allison et al. ..... D3/308
4,365,720 A * 12/1982 Kaneshiro ..... 211/70.6
4,509,648 A * 4/1985 Govang et al. ..... 211/70.6
4,653,637 A * 3/1987 Wallace ..... 206/372
4,667,822 A * 5/1987 Coopmans ..... 206/373
4,681,233 A * 7/1987 Roth ..... 211/70.6
4,961,295 A * 10/1990 Kosch et al. ..... 211/94.02
5,516,298 A * 5/1996 Smith ..... 439/131
5,641,079 A * 6/1997 Schmidt ..... 211/70.6
5,711,435 A 1/1998 Morison et al.
5,743,416 A * 4/1998 Yemini ..... 211/70.6
5,823,364 A * 10/1998 Mucciacciaro ..... 211/70.6
5,988,408 A 11/1999 Evans et al.
6,267,064 B1 * 7/2001 Ostertag et al. ..... 108/50.02
6,349,507 B1 * 2/2002 Muellerleile ..... 52/36.5
6,425,489 B1 7/2002 Cunningham
6,481,583 B1 * 11/2002 Black et al. ..... 211/70.6
6,499,608 B1 * 12/2002 Sterling et al. ..... 211/70.6
6,702,128 B2 * 3/2004 Winig et al. ..... 211/90.01
6,811,043 B2 * 11/2004 Perkins et al. ..... 211/94.01

(Continued)

*Primary Examiner*—Michael Safavi
(74) *Attorney, Agent, or Firm*—Tara Hartman; Michael D. Lafrenz

(57) ABSTRACT

A tool caddy for use with a workroom storage system that can include slotwall panels, slot tracks, a modular workbench and a power strip. The tool caddy can be movably and removably mounted to the slotwall panels, slot tracks, or to horizontal or vertical surfaces of a workbench or other structure. The tool caddy can be removably attached to one or both ends of a power strip. A power strip with one or more tool caddies attached can be mounted to a modular workbench, slotwall panel or slot track. The tool caddy can include a hollow body having an elongated horizontal top surface with a plurality of tool receiving openings, a pair of end surfaces, a front surface and a bottom surface. The bottom surface can have a plurality of tool receiving openings that can substantially correspond to the tool receiving openings in the top surface.

19 Claims, 4 Drawing Sheets

U.S. PATENT DOCUMENTS 7,093,726 B1 * 8/2006 Holztrager ..... 211/90.01
2004/0124163 A1 * 7/2004 Perkins et al. ..... 211/94.01
2004/0144739 A1 * 7/2004 Marek ..... 211/70.6
2004/0251227 A1 * 12/2004 Perkins et al. ..... 211/189

* cited by examiner

TOOL CADDY

BACKGROUND OF THE INVENTION

1. Field of the Invention

The invention relates to a tool storage device for use with workroom storage system.

2. Description of the Related Art

There are a variety of tool holders and tool storage devices in the prior art.

SUMMARY OF THE INVENTION

The invention relates to a tool caddy for movable and removable mounting on a member having at least one slat defined by spaced apart slots. The tool caddy can comprise a hollow body having an elongated horizontal top surface having a plurality of tool receiving openings, a pair of end surfaces, a front surface and a bottom surface. A downwardly opening hook can extend from the edge of the top surface opposite the front surface to hook over the top edge of a slat. A rear surface can extend upwardly from the edge of the bottom surface opposite the front surface and can have an upwardly opening hook extending in a rearward direction from the rear surface spaced below the downwardly opening hook to extend into the slot forming the bottom edge of the slat.

The upwardly opening hook can extend into the slot forming the bottom edge of a first slat without engaging the bottom edge of the first slat when the downwardly opening hook engages the top edge of a first slat. The rear surface can rest against a second slat when the tool caddy is installed on a member with the downwardly opening hook engaging the top edge of the first slat. The upwardly opening hook can extend into the slot forming the bottom edge of the first slat above the top edge of the second slat.

The end surfaces can include spaced apart openings for receiving fasteners for mounting the tool caddy to a vertical surface. The spaced apart openings can be keyhole shaped openings.

The bottom surface can have at least one opening corresponding to at least one of the tool receiving openings in the top surface. The at least one opening in the bottom surface can comprise an elongated opening corresponding to a plurality of the openings in the top surface. The bottom surface can include a plurality of tool receiving openings substantially corresponding to the tool receiving openings in the top surface.

In another aspect the invention relates to a tool caddy for movable and removable use with a workroom organization system. The workroom organization system can include a workbench including a work surface and multiple legs extending from the work surface to support the work surface above a floor, a member positioned adjacent the workbench top having at least one slat defined by spaced apart slots, and a power strip housing adjacent to the workbench top. The power strip can include one or more electrical outlets on the front surface of the housing connected to power cord extending from power strip to connect the electrical outlets to a power source. The tool caddy can include a hollow body having an elongated horizontal top surface that can have a plurality of tool receiving openings, a pair of end surfaces, a front surface and a bottom surface. A downwardly opening hook can extend from the edge of the top surface opposite the front surface to hook over the top edge of a slat. A rear surface can extend upwardly from the edge of the bottom surface opposite the front surface and can have an upwardly opening hook that can extend in a rearward direction from the rear surface and spaced below the downwardly opening hook to extend into the slot forming the bottom edge of the slat. Spaced apart openings in the tool caddy end surfaces can receive fasteners for mounting the tool caddy to a vertical surface. Spaced apart openings in the bottom surface can receive fasteners for mounting the tool caddy to a horizontal surface.

The power strip housing can include end walls that can have fasteners to fasten a tool caddy to at least one of the power strip housing end walls. A tool caddy can be attached to each end wall with fasteners to movably mount the power strip and tool caddies on the member.

In another aspect the invention relates to a tool caddy for use with a workroom organization system including at least one member having at least one slat defined by spaced apart slots mounted to a wall of the workroom. The tool caddy can include a hollow body having an elongated horizontal top surface that can have a plurality of tool receiving openings, a pair of end surfaces, a front surface and a bottom surface. The bottom surface can have a plurality of tool receiving openings substantially corresponding to the tool receiving openings in the top surface. A downwardly opening hook can extend from the edge of the top surface opposite the front surface to hook over the top edge of a slat. A rear surface can extend upwardly from the edge of the bottom surface opposite the front surface and can have an upwardly opening hook extending in a rearward direction from the rear surface and spaced below the downwardly opening hook to extend into the slot forming the bottom edge of the slat. Spaced apart openings in the end surfaces can receive fasteners. The storage system further comprises a power strip that can include a housing with end walls and one or more electrical outlets connected to a power cord extending from the power strip to allow connection of the electrical outlets to a power source. The power strip can include fasteners in the end walls arranged to be received in the spaced apart openings in the tool caddy end surfaces to removably attach a tool caddy to each end of the power strip. The tool caddies can mount the power strip and tool caddies to the at least one member or to a horizontal surface.

DESCRIPTION OF THE INVENTION

Tool caddies according to the invention can be used in conjunction with slotwall panel storage systems as disclosed in U.S. Pat. No. 6,811,043 and with workroom storage systems as disclosed in co-pending U.S. patent application Ser. No. 10/760,168. U.S. Pat. No. 6,811,043 and U.S. patent application Ser. No. 10/760,168 are incorporated by reference. A tool caddy according to the invention can allow a user to store and organize tools at their fingertips on a slotwall panel or slot track storage system. A tool caddy according to the invention can be attached to a vertical or horizontal surface and can be attached to a power strip. The power strip can be mounted on a workbench or can be mounted on a slotwall panel or slot track storage system by attaching a tool caddy at each end of the power strip to movably support the power strip at a convenient location for use.

Figure 1:
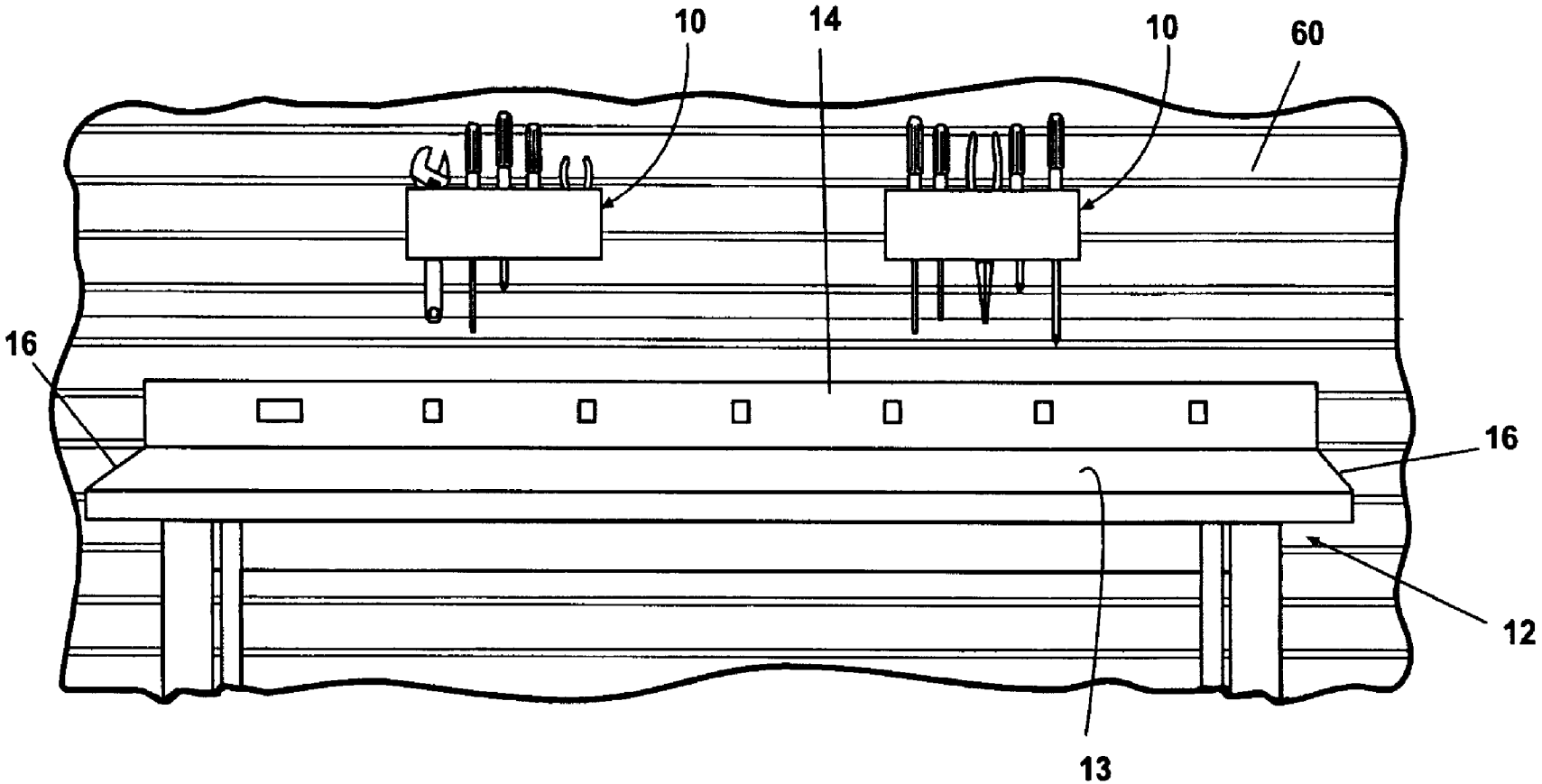
FIG. 1 is a front view illustrating tool caddies according to the invention mounted on a slotwall panel above a workbench.
Figure 2:
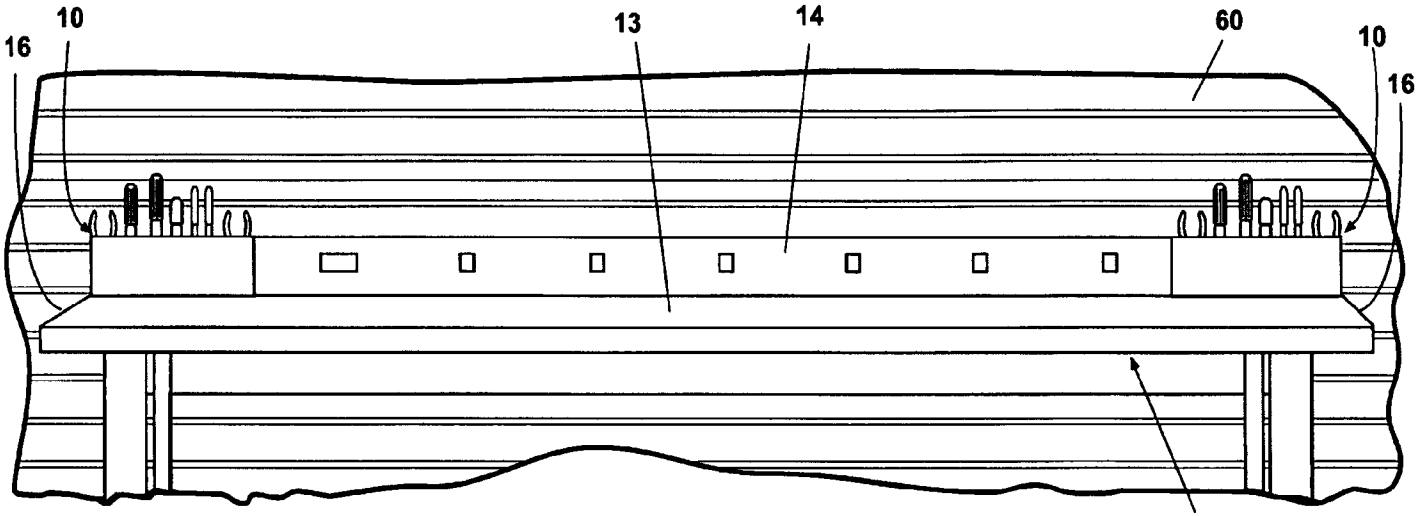
FIG. 2 is a front view illustrating tool caddies according to the invention attached to a power strip mounted on a workbench.
Figure 2A:
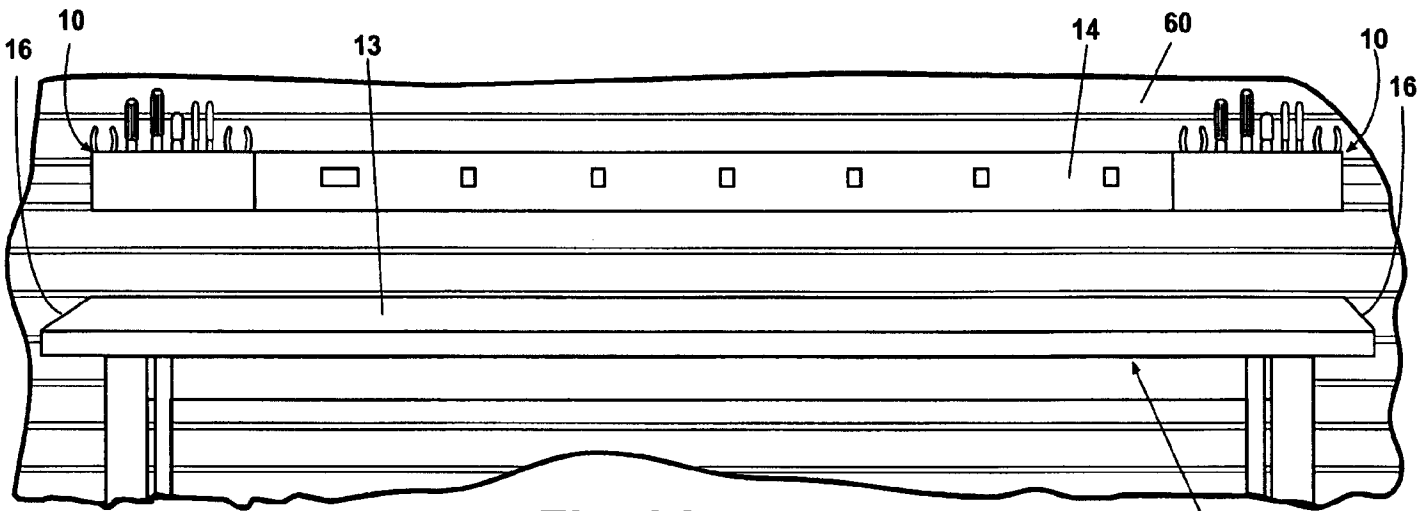
FIG. 2A is a front view illustrating tool caddies according to the invention attached to a power strip mounted on a slotwall panel above a workbench.

Turning to FIGS. 1 and 2A, tool caddies 10 can be seen mounted on a slotwall panel 60 adjacent a workbench 12 supporting a plurality of hand tools. As will be described in detail below a tool caddy 10 according to the invention can be readily movably positioned on a slotwall panel 60. Those skilled in the art will understand that a slot track (not shown) can be used to mount one or more tool caddies in lieu of, or in addition to, a slotwall panel 60 as shown in the drawings. Slot tracks are shown in detail in co-pending U.S. patent application Ser. No. 10/760,168. Slotwall panel 60 is described in detail in U.S. Pat. No. 6,811,043 and in co-pending U.S. patent application Ser. No. 10/760,168. Modular workbenches are described in detail in co-pending U.S. patent application Ser. No. 10/760,168. As shown in FIG. 2A, a tool caddy 10 can be mounted on the opposite ends of a power strip 14 to mount the power strip on a slotwall panel 60 adjacent a modular workbench 12. Those skilled in the art will understand that a tool caddy and power strip assembly can be mounted on a slotwall panel or slot track for use or storage away from a modular workbench if desired. As shown in FIG. 2, a tool caddy 10 can be mounted on the opposite ends of a power strip 14 that can be mounted to, or adjacent to, a workbench top 13 of a modular workbench 12 as disclosed in co-pending U.S. patent application Ser. No. 10/760,168. While two tool caddies 10 are shown in FIG. 2 those skilled in the art will understand that only one tool caddy 10 can be mounted on one end of a power strip 14 if desired. Likewise a power strip 14 and tool caddy 10 assembly as shown in FIG. 2 can be mounted on a shorter workbench 12 with tool caddies 10 extending beyond the ends 16 of workbench 12.

Figure 3B:
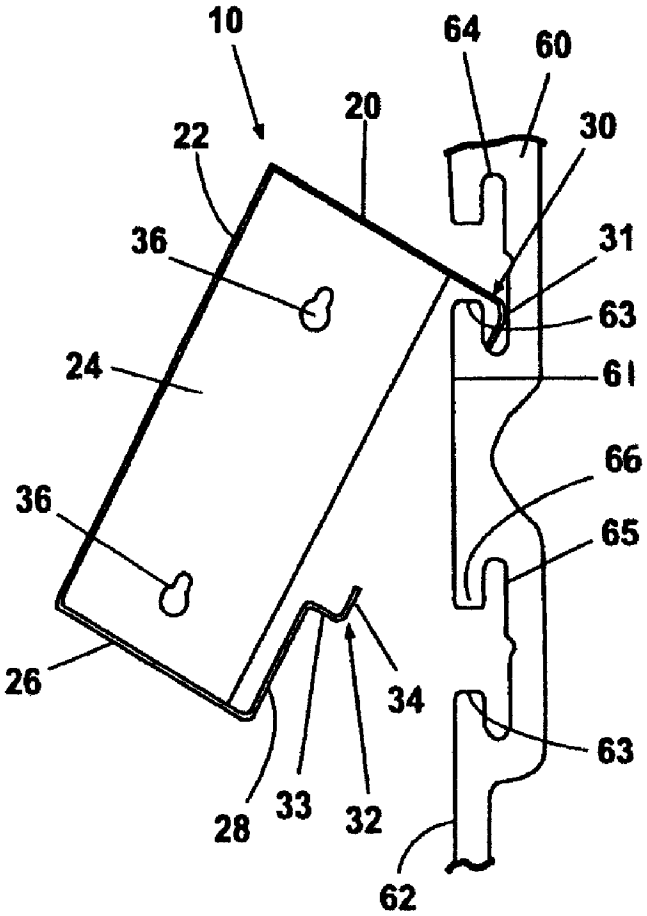
FIG. 3B is an end view of a tool caddy according to the invention on a slotwall panel tipped up at the front edge of the tool caddy illustrating how the tool caddy stays on the slotwall panel when the front edge of the tool caddy is displaced upwardly.
Figure 3A:
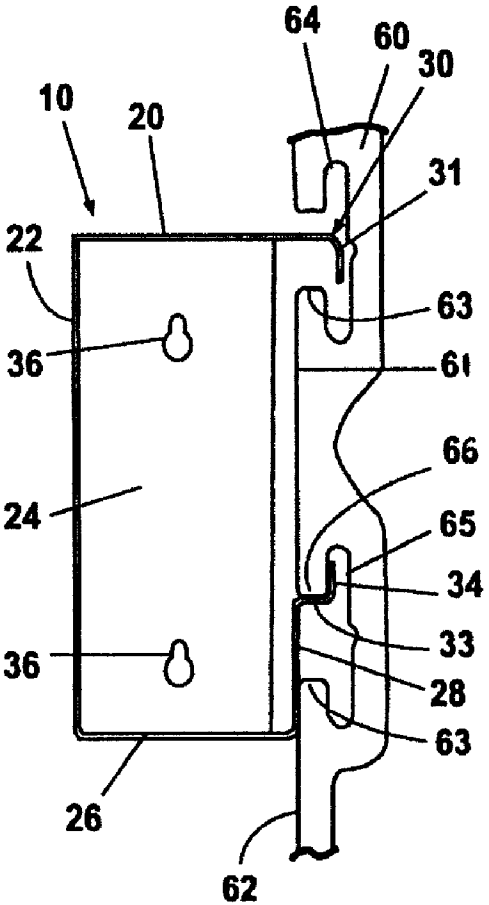
FIG. 3A is an end view of a tool caddy according to the invention on slotwall panel that has been displaced vertically illustrating how the tool caddy stays on the slotwall panel when the tool caddy is displaced generally vertically.
Figure 3:
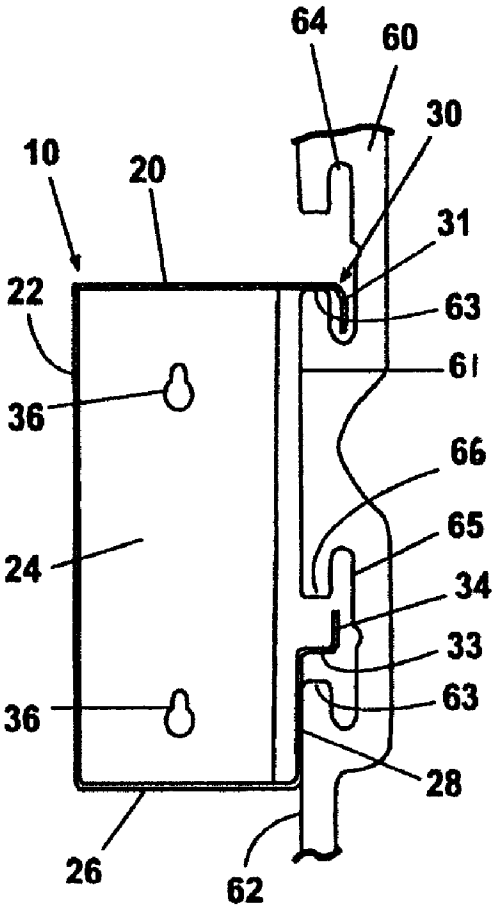
FIG. 3 is an end view of a tool caddy according to the invention mounted on a slotwall panel.
Figure 4:
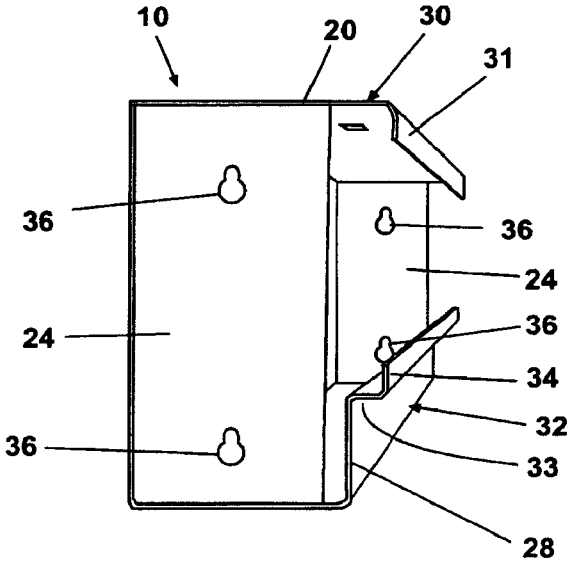
FIG. 4 is a rear perspective view of a tool caddy according to the invention.

Turning to FIGS. 3-4, a tool caddy 10 can have an elongated top surface 20, a front surface 22, two end surfaces 24 and a bottom surface 26. The tool caddy according to the invention is illustrated as an elongated or rectangular body. Those skilled in the art will understand that the top, front, end and bottom surfaces can be rectangular as shown, or can be other polygons, if desired, within the scope of the invention. A downwardly opening hook 30 can extend downwardly from the edge of the top surface 20 opposite the front surface 22. Downwardly opening hook 30 can be formed by a downwardly extending leg 31 at the rear edge of top surface 20. Tool caddy 10 can have a rear surface 28 extending upwardly from the edge of bottom surface 26 opposite front surface 22. An upwardly opening hook 32 can extend rearwardly and upwardly from the top edge of rear wall 28. Upwardly extending hook 32 can be formed by a horizontal leg 33 extending rearwardly from the top edge of rear surface 28 and upwardly extending leg 34 extending upwardly from the rear edge of horizontal leg 33. Downwardly extending hook 30 can be dimensioned to easily fit over a top edge 63 of a first slat 61 of a slotwall panel 60. The top and bottom edges 63, 66 of slats 61, 62 are defined by undercuts 64 between slats 61, 62 and bottom wall 65. Downwardly opening hook 30 and upwardly opening hook 32 can be vertically spaced so that when downwardly opening hook 30 is hooked over the bottom edge 63 of the first slat 61 upwardly opening hook 32 is positioned between the bottom edge 66 of the first slat 61 and the top edge 63 of adjacent second slat 62. Rear surface 28 can engage the surface of the second slat 62 to support the tool caddy generally parallel to the faces of slats 61, 62 Thus, a tool caddy can be supported on a slotwall panel, or slot track, by hooking the downwardly opening hook 30 over a top edge 63 of a first slat 61 and allowing the tool caddy to swing down so that rear surface 28 can engage the face of an adjacent second slat 62.

As shown in FIGS. 3A and 3B, the arrangement of the downwardly opening hook 30 and upwardly opening hook 32 can assure that a tool caddy is not inadvertently dislodged from a slotwall panel or slot track. In the event a tool caddy 10 is displaced vertically, as shown in FIG. 3A, upwardly opening hook 32 engages the bottom edge 66 of the first slat 61 before downwardly opening hook 30 disengages top edge 63 of the first slat 61 thus preventing tool caddy 10 from falling off the slotwall panel 60. In the event a tool caddy 10 is pivoted outwardly, as shown in FIG. 3B, downwardly opening hook 30 remains in engagement with top edge 63 of the first slat 61. Once tool caddy 10 is released the weight of tool caddy 10 will cause tool caddy to fall to a vertical position with rear wall 28 engaging the face of the adjacent second slat 62 as shown in FIG. 3. Tool caddy 10 can easily be removed from a slotwall panel 60 by tipping the tool caddy 10 outwardly at the bottom in order for upwardly opening hook 32 to clear the bottom edge 66 of the first slat 61 and then lifting tool caddy vertically until downwardly opening hook 30 clears the top edge 63 of the first slat 61. Tool caddy 10 can be easily moved while mounted on a slat 61, 62 by simply pushing the tool caddy along a slat 61, 62.

Figure 6:
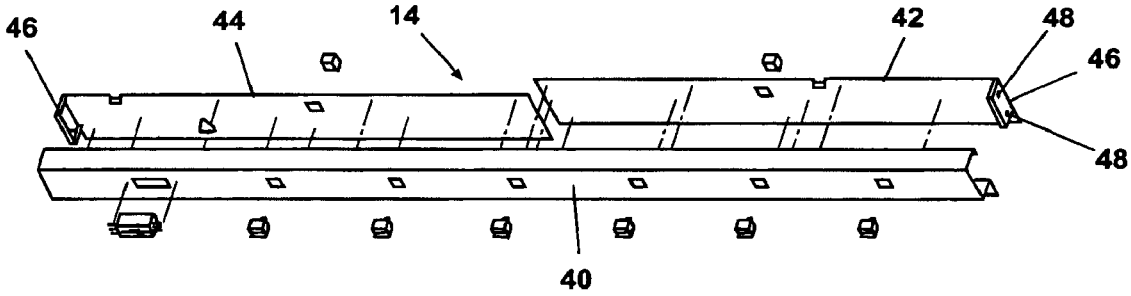
FIG. 6 is an exploded view of a power strip that can be used with a tool caddy according to the invention.

A tool caddy 10 can be mounted to a power strip 14 as shown in FIGS. 2, 2A and 6. Tool caddy 10 can have spaced openings 36 in the end surfaces 24 to receive fasteners to attach a tool caddy to an end of a power strip 14. As shown in FIGS. 3 and 4 the openings 36 in end surfaces 24 can be keyhole openings to facilitate mounting a tool caddy 10 to a power strip 14. While spaced openings 36 are shown as keyhole openings, those skilled in the art will understand that round or oblong openings can be provided in lieu of keyhole shaped openings. Power strip 14 can include a front wall 40 and rear walls 42 and 44. Rear walls 42 and 44 can have an end wall 46 that can be arranged to close the end of the housing for the power strip formed when front wall 40 and rear walls 42 and 44 are assembled. As disclosed in co-pending U.S. patent application Ser. No. 10/760,168 power strip 14 can include a plurality of electrical outlets on front wall 40 and on rear walls 42 and 44. Also, suitable switches, overload or surge protectors or ground fault protectors can be provided as is well known in the art. A power cord (not shown) can be included to allow connecting the power strip to an electrical outlet. End walls 46 can have spaced openings 48 to receive fasteners to attach a tool caddy 10 to one or both end walls. To attach a tool caddy 10 to the power strip 14 fasteners such as threaded fasteners can be started in openings 48. A tool caddy 10 can be positioned on the fasteners (not shown) by inserting the heads of the fasteners into the large end of the keyhole openings 36 in end surface 24 and allow tool caddy to move downwardly so that the fasteners engage the small end of keyhole openings 36. If it is desired to have a tool caddy removably supported on the power strip the fasteners need not be tightened. On the other hand if it is desired to have the tool caddy securely attached to the power strip the fasteners can be tightened to securely hold tool caddy 10 on end wall 46 of the power strip 14. As described above, a power strip can be arranged to be movably mounted on a slotwall panel, or slot track (not shown) by securely attaching a tool caddy 10 to each end wall 46 of a power strip 14. The tool caddy and power strip assembly can be easily mounted on a slotwall panel by hooking the downwardly opening hook 30 of each tool caddy 10 over a selected top edge 63 of a first slat 61 of a slotwall panel and allowing the assembly to swing downwardly so that rear surface 28 and rear walls 42 and 44 engage a second slat 62. As also described above, power strip 14 can be attached to a modular workbench 12 and can have a tool caddy 10 attached at each end of power strip 14 as shown in FIG. 2. A tool caddy 10 can be securely or removably attached to each end of power strip 14. Similarly, one or two tool caddies 10 could be securely or removably attached to the ends or power strip 14 attached to workbench 12 as shown in FIG. 1. In this embodiment the tool caddy or tool caddies could extend beyond the edge 16 of workbench 12.

Figure 5:
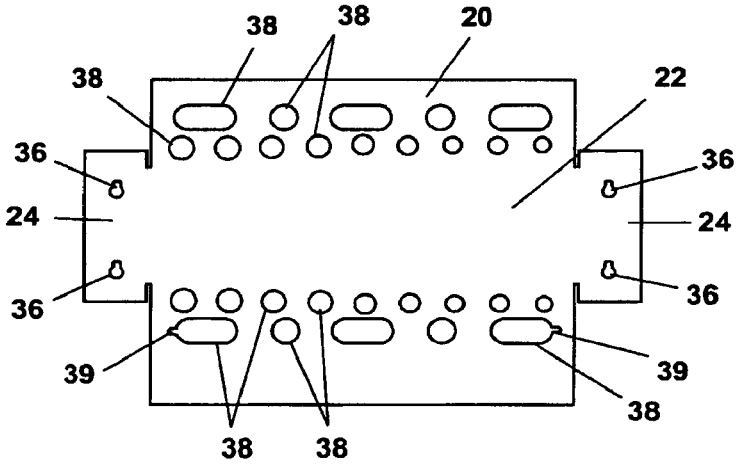
FIG. 5 is a plan view of a flat pattern for a tool caddy according to the invention.

Turning to FIG. 5, a tool caddy 10 can be seen in blank form prior to folding into final form. Tool caddy 10 can be formed of steel or other suitable sheet material. Top surface 20 and bottom surface 26 can have a plurality of tool holes 38. Tool holes 38 can be round or elongated and can vary in size to facilitate holding different size and shape tools as is well known in the art. The tool holes 38 in the bottom surface 26 can correspond to the tool holes 38 in the top surface 20. Those skilled in the art will understand that, alternately, tool holes can be omitted in bottom surface 26, or bottom surface 26 can have a single elongated hole (not shown) corresponding to some or all of the tool holes in the top surface. Tool caddy 10 can be formed from the blank shown in FIG. 5 by folding the surfaces into the configuration shown in FIGS. 1-4 and welding, or otherwise attaching the end surfaces to the top and bottom surfaces. The tool caddy 10 can be provided with a suitable finish to protect the sheet material in use.

In use, hand tools such as screwdrivers, pliers, wrenches, chisels and nut drivers and the like can be placed in tool holes 38 in the tool caddy 10. When corresponding tool holes are provided in bottom surface 26, elongated tools can have a portion extending through the bottom surface as shown in FIG. 1. When a tool caddy 10 is mounted on the surface of a modular workbench 12, or when the bottom surface of tool caddy 10 is not provided with tool holes, tools can be stored in the tool caddy 10 by placing the tools in tool holes 38 in the top surface 20 as shown in FIG. 2. Those skilled in the art will understand that a workbench top 13 can have cut out openings (not shown) positioned to allow tools extending through the bottom wall 26 of a tool caddy 10 to extend into/through the workbench top 13. A tool caddy 10 can also be directly attached to a surface such as workbench top 13. Elongated tool holes 38 in bottom surface 26 can include a mounting slot 39 that can accommodate a fastener to mount the tool caddy 10 to a surface. Those skilled in the art will understand that mounting slots 39 can be arranged other than a shown in FIG. 5 to allow a tool caddy 10 to be slipped over a pair of fasteners started in a mounting surface. For example, mounting slots 39 can be positioned on corresponding edges of two tool holes such as positioned on the right or left edges of the elongated tool holes 38. Mounting slots 39 could be positioned on other edges of tool hole openings.

While the invention has been specifically described in connection with certain specific embodiments thereof, it is to be understood that this is by way of illustration and not of limitation, and the scope of the appended claims should be construed as broadly as the prior art will permit.

We claim:

1. A tool caddy comprising:

a generally rectangular hollow body having an elongated horizontal top wall having a plurality of tool receiving openings, a pair of end walls connected to the top wall, a front wall connected to the top wall and the end walls and a bottom wall connected to the front wall and the end walls and arranged to be mounted on multiple surfaces;

a first mounting arrangement for movable and removable mounting on a generally vertical member having at least one slat having a top and bottom edge defined by spaced apart slots comprising:

an elongated downwardly opening hook extending from the edge of the top wall opposite the front wall arranged to hook over the top edge of a first slat; and a rear wall extending upwardly from the edge of the bottom wall opposite the front wall having an elongated upwardly opening hook extending in a rearward direction from the rear wall and spaced below the downwardly opening hook arranged to extend into the slot forming the bottom edge of the first slat without engaging the bottom edge of the first slat when the downwardly opening hook engages the top edge of the first slat;

where, in the event a tool caddy positioned on a generally vertical member is displaced vertically, the upwardly opening hook engages the bottom edge of the first slat before the downwardly opening hook disengages the top edge of the first slat to assure the tool caddy is not inadvertently dislodged from the generally vertical member as a result of the vertical displacement while allowing the tool caddy to be pushed along the first slat to any desired position.

2. The tool caddy according to claim 1, wherein the generally vertical member has a second slat and the rear wall rests against the second slat when the tool caddy is installed on the generally vertical member with the downwardly opening hook engaging the top edge of the first slat.

3. The tool caddy according to claim 2, wherein the upwardly opening hook extends into the slot forming the bottom edge of the first slat above the top edge of the second slat.

4. The tool caddy according to claim 1, further including a second mounting arrangement wherein the end walls include spaced apart openings for receiving fasteners for attaching a tool caddy to a vertical surface.

5. The tool caddy according to claim 4, wherein the spaced apart openings are keyhole shaped openings.

6. The tool caddy according to claim 1, further including a third mounting arrangement wherein the bottom wall includes spaced apart openings for receiving fasteners for attaching the tool caddy to a horizontal surface.

7. The tool caddy according to claim 1, wherein the bottom wall has at least one opening corresponding to at least one of the tool receiving openings in the top surface.

8. The tool caddy according to claim 7, wherein the at least one opening in the bottom wall comprises an elongated opening corresponding to a plurality of the openings in the top wall.

9. The tool caddy according to claim 1, wherein the bottom wall includes a plurality of tool receiving openings substantially corresponding to the tool receiving openings in the top surface.

10. A tool caddy in combination with a workroom organization system comprising:

a workbench including a work surface and multiple legs extending from the work surface to support the work surface above a floor;

a generally vertical member positioned adjacent to the workbench top having at least one slat defined by spaced apart slots; and a power strip including a housing having a front surface adjacent to the workbench top including one or more electrical outlets on the front surface of the housing connected to a power cord extending from the power strip to connect said electrical outlets to a power source;

the tool caddy comprising:

a generally rectangular hollow body having an elongated horizontal top wall having a plurality of tool receiving openings, a pair of end walls connected to the top wall, a front wall connected to the top wall and the end walls and a bottom wall connected to the front wall and the end walls and arranged to be mounted on multiple surfaces;

a first mounting arrangement for movable and removable mounting on the generally vertical member comprising;

a downwardly opening hook extending from the edge of the top wall opposite the front wall arranged to hook over the top edge of a first slat;

a rear wall extending upwardly from the edge of the bottom wall opposite the front wall having an upwardly opening hook extending in a rearward direction from the rear wall and spaced below the downwardly opening hook arranged to extend into the slot forming the bottom edge of the first slat without engaging the bottom edge of the first slat when the downwardly opening hook engages the top edge of the first slat; and a second mounting arrangement including spaced apart openings in the end walls for receiving tool caddy mounting fasteners for mounting a tool caddy on a vertical surface;

where, in the event a tool caddy positioned on a generally vertical member is displaced vertically, the upwardly opening hook engages the bottom edge of the first slat before the downwardly opening hook disengages the top edge of the first slat to assure the tool caddy is not inadvertently dislodged from the generally vertical member as a result of the vertical displacement while allowing the tool caddy to be pushed along the first slat to any desired position.

11. The tool caddy according to claim 10, further including a third mounting arrangement including spaced apart openings in the bottom wall for receiving tool caddy mounting fasteners for mounting the tool caddy to a horizontal surface.

12. The tool caddy according to claim 10, wherein the work surface includes a vertical surface on ends of the work surface and the tool caddy mounting fasteners are fastened to at least one of the vertical surfaces on the ends of the work surface.

13. The tool caddy according to claim 10, wherein the power strip housing is attached to the work surface.

14. A tool caddy in combination with a workroom organization system comprising:

a workbench including a work surface and multiple legs extending from the work surface to support the work surface above a floor;

a generally vertical member positioned adjacent to the workbench top having at least one slat defined by spaced apart slots; and a power strip including a housing having a front surface adjacent to the workbench top including end walls and one or more electrical outlets on the front surface of the housing connected to a power cord extending from the power strip to connect said electrical outlets to a power source;

the tool caddy comprising:

a generally rectangular hollow body having an elongated horizontal top wall having a plurality of tool receiving openings, a pair of end walls connected to the top wall, a front wall connected to the top wall and the end walls and a bottom wall connected to the front wall and the end walls and arranged to be mounted on multiple surfaces;

a first mounting arrangement for movable and removable mounting on the generally vertical member comprising;

a downwardly opening hook extending from the edge of the top wall opposite the front wall arranged to hook over the top edge of a slat;

a rear wall extending upwardly from the edge of the bottom wall opposite the front wall having an upwardly opening hook extending in a rearward direction from the rear wall and spaced below the downwardly opening hook arranged to extend into the slot forming the bottom edge of the slat; and a second mounting arrangement including spaced apart openings in the end walls for receiving tool caddy mounting fasteners, the tool caddy mounting fasteners being fastened to at least one of the power strip housing end walls;

where, in the event a tool caddy positioned on a generally vertical member is displaced vertically, the upwardly opening hook engages the bottom edge of the first slat before the downwardly opening hook disengages the top edge of the first slat to assure the tool caddy is not inadvertently dislodged from the generally vertical member as a result of the vertical displacement while allowing the tool caddy to be pushed along the first slat to any desired position.

15. The tool caddy according to claim 14, wherein a tool caddy is attached to the power strip housing on each end wall with the tool caddy mounting fasteners to movably mount the power strip and tool caddies on the generally vertical member.

16. The tool caddy according to claim 15, wherein the generally vertical member comprises a slot wall panel having a plurality of slots forming a plurality of slats.

17. Tool caddies in combination with a workroom organization system including at least one generally vertical member having at least one slat defined by spaced apart slots mounted to a wall of the workroom and a power strip including a housing with end walls and one or more electrical outlets connected to a power cord extending from the power strip to allow connection of the electrical outlets to a power source;

each tool caddy comprising:

a generally rectangular hollow body having an elongated horizontal top wall having a plurality of tool receiving openings, a pair of end walls connected to the top wall, a front wall connected to the top wall and the end walls and a bottom wall connected to the front wall and the end walls with a plurality of tool receiving openings substantially corresponding to the tool receiving openings in the top surface arranged to be mounted on multiple surfaces;

a first mounting arrangement for movable and removable mounting on the generally vertical member comprising:

an elongated downwardly opening hook extending from the edge of the top wall opposite the front wall arranged to hook over the top edge of a slat;

a rear wall extending upwardly from the edge of the bottom wall opposite the front wall having an elongated upwardly opening hook extending in a rearward direction from the rear wall and spaced below the downwardly opening hook arranged to extend into the slot forming the bottom edge of the slat; and a second mounting arrangement including spaced apart openings in the end walls for receiving fasteners provided on the power strip end walls for removably mounting a tool caddy to each end of the power strip to mount the power strip and tool caddies to the at least one generally vertical member;

where, in the event tool caddies positioned on a generally vertical member are displaced vertically, the upwardly opening hooks engage the bottom edge of the first slat before the downwardly opening hooks disengage the top edge of the first slat to assure the tool caddies are not inadvertently dislodged from the generally vertical member as a result of the vertical displacement while allowing the tool caddies to be pushed along the first slat to any desired position; and further where, in the event the tool caddies are pivoted outward, the downwardly opening hooks remain engaged with the top edge of the first slat to assure the tool caddies will fall to a vertical position when released and not be inadvertently dislodged from the generally vertical member.

18. The tool caddy according to claim 17, further including a third mounting arrangement including mounting slots in the bottom wall arranged to receive fasteners for mounting the power strip and tool caddies to a horizontal surface.

19. The tool caddy according to claim 18, wherein the workroom system further includes a modular workbench and the horizontal surface is the workbench top.

* * * * *